US005579931A

United States Patent [19]

Zuehlke et al.

[11] Patent Number: 5,579,931

[45] Date of Patent: Dec. 3, 1996

[54] LIFTCRANE WITH SYNCHRONOUS ROPE OPERATION

[75] Inventors: Arthur G. Zuehlke; David J. Pech, both of Manitowoc, Wis.

[73] Assignee: Manitowoc Engineering Company, Manitowoc, Wis.

[21] Appl. No.: 210,988

[22] Filed: Mar. 18, 1994

Related U.S. Application Data

[63] Continuation-in-part of Ser. No. 566,751, Aug. 13, 1990, Pat. No. 5,297,019, which is a continuation-in-part of Ser. No. 418,879, Oct. 10, 1989, Pat. No. 5,189,605.

[51] Int. Cl.[6] ..... B66D 1/26

[52] U.S. Cl. ..... 212/276; 212/274; 212/281; 254/285

[58] Field of Search ..... 212/153, 159, 212/190, 191, 274, 276, 284, 281; 254/267, 269, 270, 281, 285

[56] References Cited

U.S. PATENT DOCUMENTS

| | | | |
|---|---|---|---|
| 2,030,529 | 2/1936 | Nash | 212/153 |
| 3,265,360 | 8/1966 | Tax | 254/285 |
| 3,335,568 | 8/1967 | Van De Hey . | |
| 3,531,088 | 9/1970 | Kraschnewski . | |
| 3,620,504 | 11/1971 | Morrison | 212/274 |
| 3,851,766 | 12/1974 | Gill et al. . | |
| 4,144,974 | 3/1979 | Longthorpe | 212/274 |
| 4,178,591 | 12/1979 | Geppert . | |
| 4,185,280 | 1/1980 | Wilhelm . | |
| 4,227,676 | 10/1980 | Vaillant et al. | 212/274 |
| 4,268,013 | 5/1981 | Khan . | |
| 4,451,893 | 5/1984 | Izumi et al. . | |
| 4,489,551 | 12/1984 | Watanabe et al. . | |
| 4,506,791 | 3/1985 | Brosigke | 212/290 |
| 4,510,750 | 4/1985 | Izumi et al. . | |
| 4,514,796 | 4/1985 | Saulters et al. . | |
| 4,532,595 | 7/1985 | Wilhelm . | |

(List continued on next page.)

FOREIGN PATENT DOCUMENTS

| | | | |
|---|---|---|---|
| 0076485A1 | 4/1983 | European Pat. Off. . | |
| 0253657A2 | 1/1988 | European Pat. Off. . | |
| 7200064 | 1/1972 | France . | |
| 3115471A1 | 10/1982 | Germany . | |
| 3611553C1 | 7/1987 | Germany . | |
| 0364994A1 | 10/1989 | Germany . | |
| 40213079 | 5/1990 | Japan | 212/284 |
| 161107 | 3/1964 | U.S.S.R. | 254/285 |
| 943188 | 7/1982 | U.S.S.R. | 212/153 |
| 2234728 | 2/1991 | United Kingdom | 254/267 |

OTHER PUBLICATIONS

The Liebherr"Technical Data Cable Excavator", at p. 3, col. 1, describes a control system for a liftcrane, Oct. 1986.

The Liebherr "Technical Description", (HS 840, HS 850, HS 870) describes liftcranes including the liftcrane described in reference A, Apr. 1985.

*Primary Examiner*—Thomas J. Brahan

*Attorney, Agent, or Firm*—Brinks Hofer Gilson & Lione

[57] ABSTRACT

An improved method and system for a liftcrane in which a load is lifted through the combined action of first and second hoist drums. The method and system use a first rope wound on one hoist drum and a second rope wound on the second hoist drum. The ends of the ropes opposite the hoist drums are linked together to transmit tension between them. The load is coupled to the ropes. If the take up speed of one of the ropes exceeds the take up speed of the other, the linked ends of the ropes will shift. This condition is detected and the operation of at least one of the first and second hoist drums is modified to bring the take up rates into balance. This system is advantageously used with a hoist block sheave arrangement. This system can also be used with a single rope in which each of the ends of the single rope are wound on a separate one of the hoist drums and the load is coupled to the middle of the rope.

12 Claims, 10 Drawing Sheets

U.S. PATENT DOCUMENTS 4,782,662 11/1988 Reeves et al. .
4,815,614 3/1989 Putkonen et al. .
4,905,848 3/1990 Skjonberg ..... 212/153
4,953,723 9/1990 Saotome et al. .
4,969,562 11/1990 Saotome .
4,995,472 2/1991 Hayashi et al. .
5,029,067 7/1991 Nishida .
5,034,892 7/1991 Saotome .
5,160,056 11/1992 Yoshimatsu et al. .
5,189,605 2/1993 Zuehlke et al. .
5,297,019 3/1994 Zuehlke .

LIFTCRANE WITH SYNCHRONOUS ROPE OPERATION

REFERENCE TO RELATED APPLICATION

This application is a continuation-in-part of Ser. No. 07/566,751 filed Aug. 13, 1990 now U.S. Pat. No. 5,297,019 which is a continuation-in-part of Ser. No. 07/418,879 filed Oct. 10, 1989, now U.S. Pat. No. 5,189,605 the entire disclosures of which are incorporated herein by reference.

BACKGROUND OF THE INVENTION

The present invention relates to liftcranes and in particular to heavy duty liftcranes that use a hoist block sheave arrangement.

Liftcranes are used for a variety of lifting tasks. When liftcranes are used for lifting very heavy loads one arrangement that has been devised is to employ a hoist block sheave arrangement. A hoist block sheave arrangement uses upper and lower block halves suspended from the end of the liftcrane boom. Each of the block halves includes a plurality of corresponding sheaves. The lower block half may also include a hook or other similar device to which the load can be attached. The upper and lower block halves are connected by hoist rope or cable that is reeved through the corresponding sheaves of each block half.

The purpose of the hoist block sheave arrangement is twofold. First, the multiple sheaves connecting the upper and lower block halves provide a mechanical advantage as an arrangement of multiple pulleys. Secondly, lifting can be accomplished using two drum hoists instead of one. This latter advantage can be obtained because a single length of rope is reeved through the sheaves of the hoist block and each end of the rope is wound around a separate hoist drum on the liftcrane. Thus, the load can be lifted using not only the mechanical advantage of the multiple pulleys, but also with the lifting power of two hoist drums. Examples of liftcranes that use hoist block sheave arrangements include Models 4000, 4100, and 36 ft. platform Ringers manufactured by the Manitowoc Engineering Co. of Manitowoc, Wis. Some of these liftcranes can lift loads of 800 to 1400 tons or more.

When a hoist block sheave arrangement is used in the manner as explained above, a relatively great length of rope is required, e.g. 4500 feet. This is because a single rope is reeved through the multiple hoist block sheaves and both ends of the rope are run all the way back to the two hoist drums. Using a single rope of this great length can present disadvantages. For example, it is cumbersome to dismantle the hoist block sheave arrangement in case the liftcrane has to be moved. Also, since only a single rope of great length is used, neither the front nor the rear drum is typically large enough to hold the entire length of rope. Thus, the rope must be removed entirely from the liftcrane and wound onto a separate spool. Then, in order to use the liftcrane again, the rope must be wound off the spool and reeved through the hook block sheaves and boom and around both the front and rear drums. Thus, additional time and effort must be expended in order to take advantage of the hoist block sheave arrangement.

SUMMARY OF THE INVENTION

According to an aspect of the present invention, there is provided an improved method and system for a liftcrane in which a load is lifted through the combined action of first and second hoist drums. The method and system use two ropes. A first rope is wound on one hoist drum and a second rope wound on the second hoist drum. The ropes extend over a boom and the ends of the ropes opposite the hoist drums are linked together so that tension can be transmitted between them. The load is lifted by a hook carried by the linked ropes. If the take up speed of one of the ropes exceeds the take up speed of the other rope, the linked ends of the ropes will shift. This condition is detected and the operation of at least one of the first and second hoist drums is modified to adjust the take up rates of the two ropes into balance. This system is advantageously used with a hoist block sheave arrangement.

DESCRIPTION OF PRESENTLY PREFERRED EMBODIMENTS

Figures 1, 2:
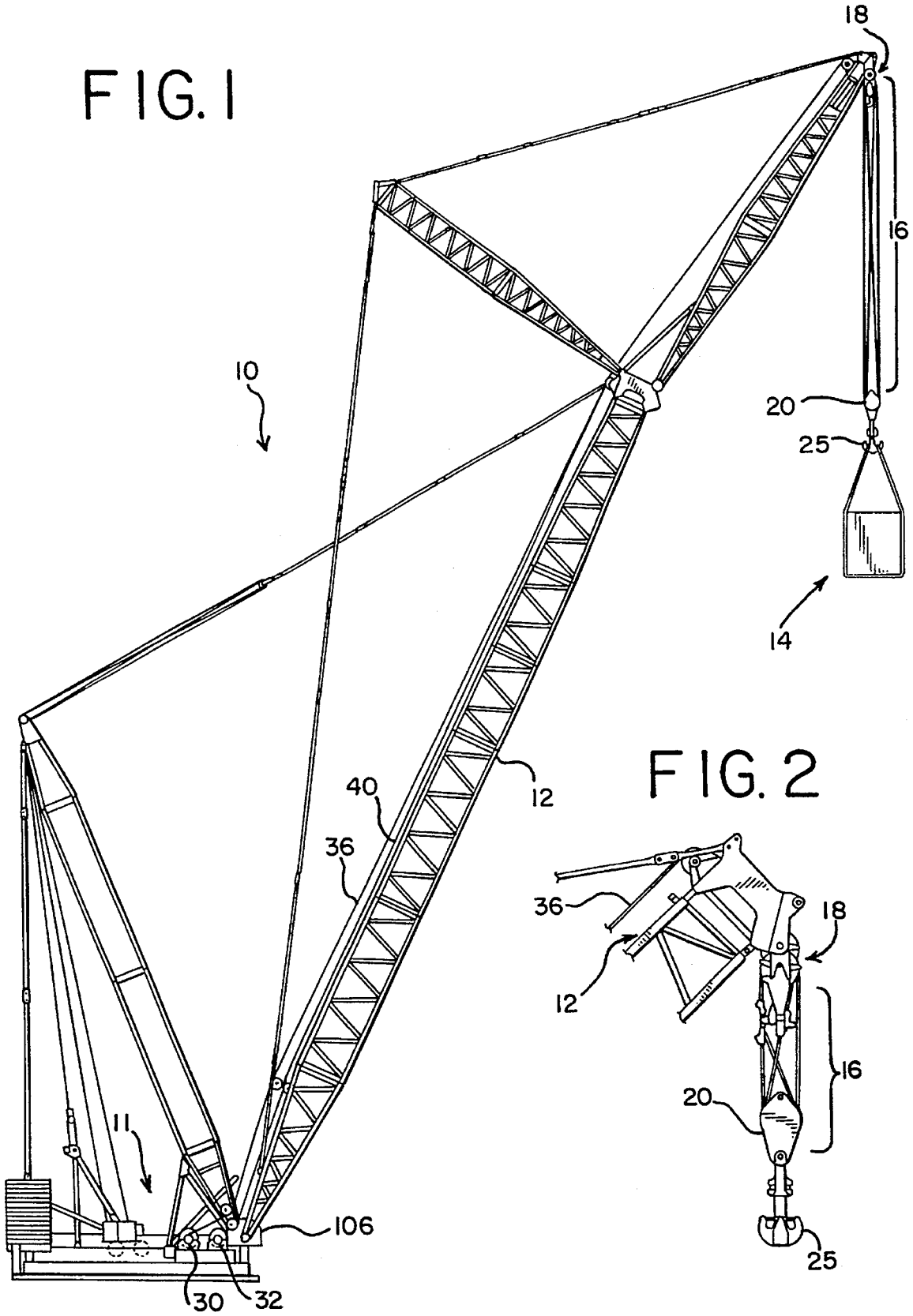
FIG. 1 is a side view of a liftcrane incorporating a first embodiment of the present invention.
FIG. 2 is an expanded view of the top end of the boom of the liftcrane shown in FIG. 1.

FIG. 1 depicts a heavy duty liftcrane 10 having an upper works 11 to which is attached a boom 12 that is used to lift a heavy load 14. The liftcrane 10 also includes an engine to deliver power to the various mechanical systems of the liftcrane and a hydraulic system including actuators and pumps. For additional details regarding these aspects of the liftcrane, reference is made to the related applications Ser. Nos. 07/566,751 and 07/418,879, referred to above.

Figure 3:
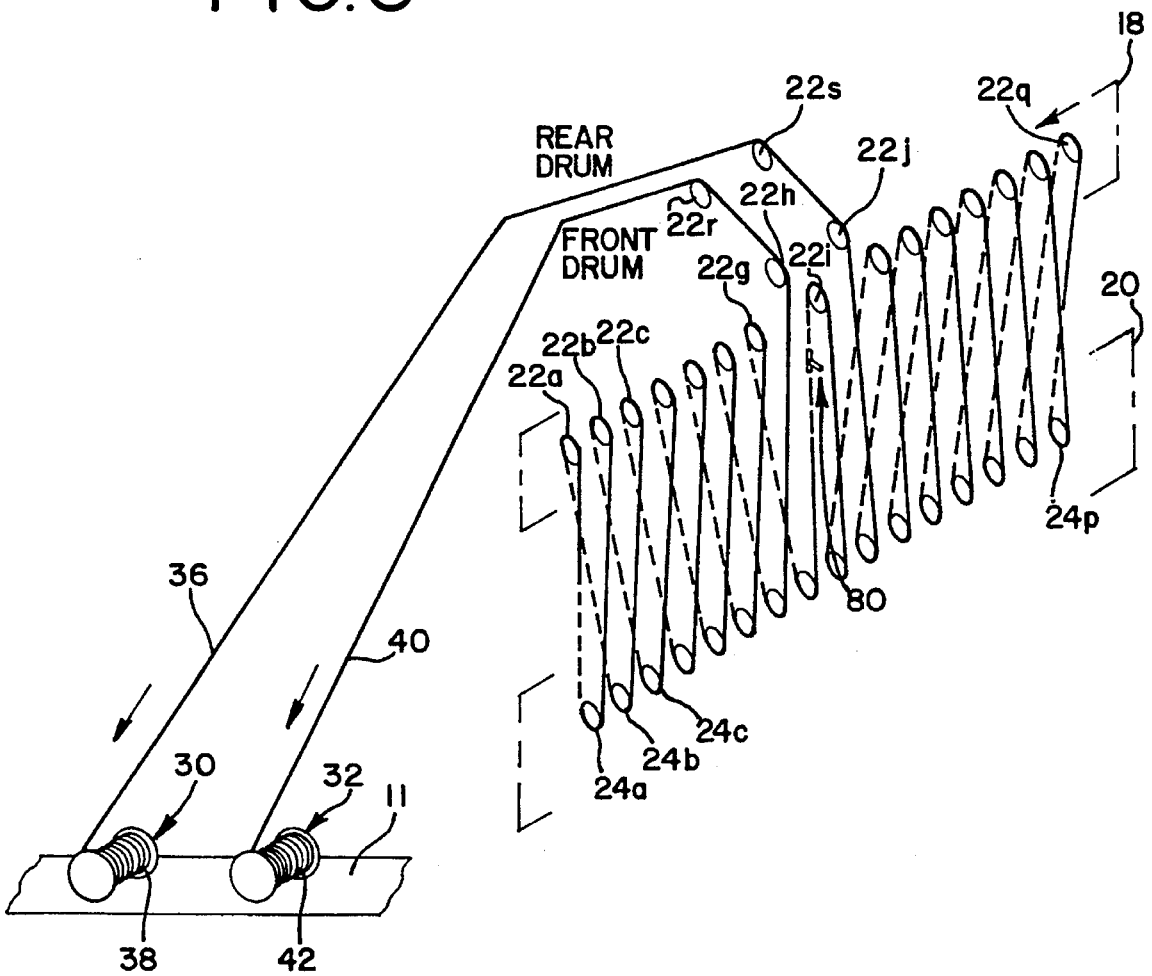
FIG. 3 is a diagram illustrating the reeving arrangement of the liftcrane shown in FIG. 1.
Figure 4:
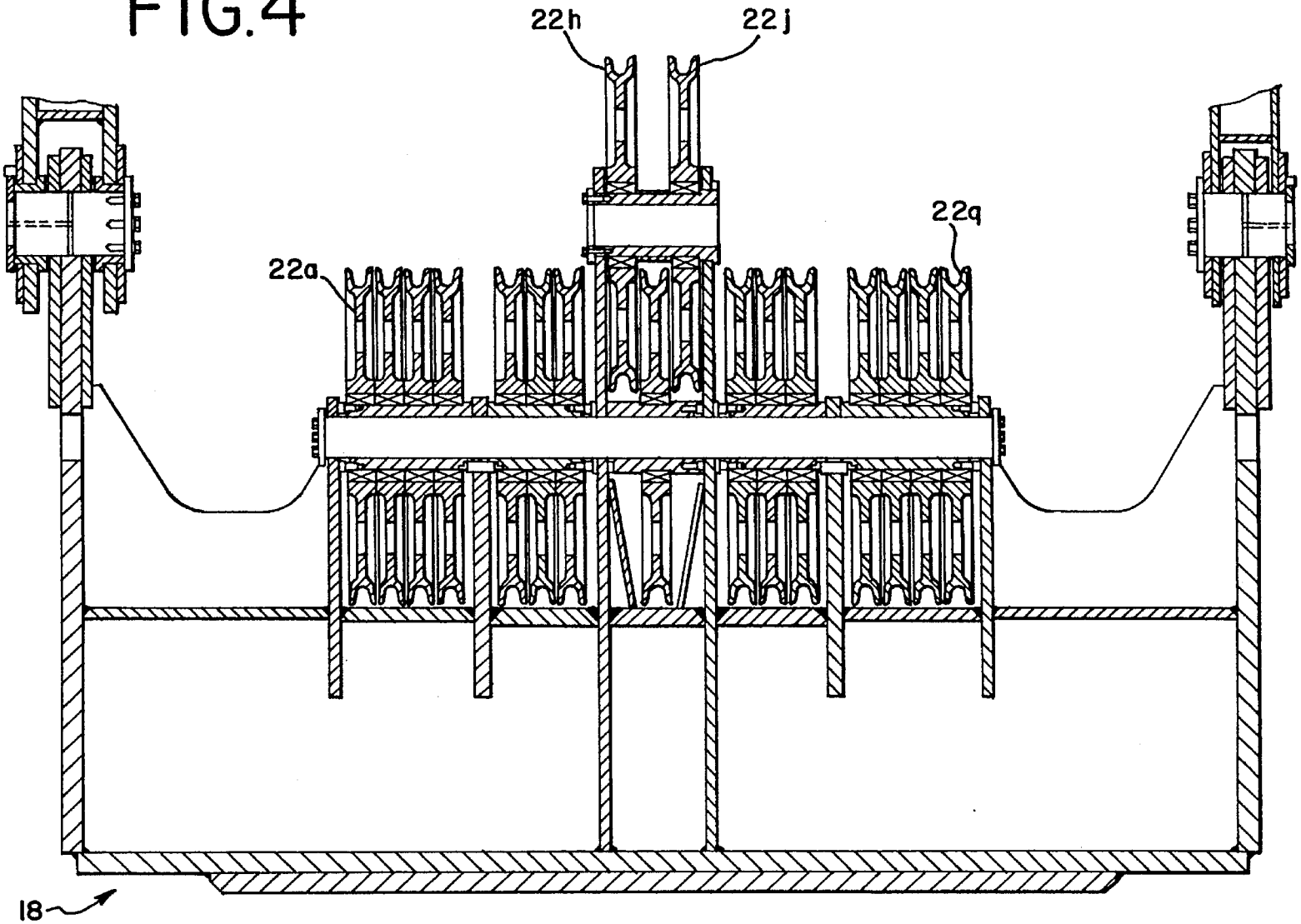
FIG. 4 is a sectional view of the upper half of the hoist block sheave arrangement shown in the embodiment of FIG. 1.

With very heavy loads, a hook block sheave arrangement 16 is used. Referring to FIG. 2, the hook block sheave arrangement 16 includes an upper block half 18 and a lower block half 20. As illustrated in the diagram of FIG. 3 and in FIGS. 4–7, located on the upper block half 18 are a plurality of sheaves 22 (designated 22*a*–22*s*) and located on the lower block half 20 are a plurality of sheaves 24 (designated 24*a*–24*p*) which correspond to the sheaves 22 on the upper block half 18. A hook 25 is connected to the lower block half 20.

Lifting of the load 14 with the hook block sheave arrangement 16 is accomplished with two hoist drums. Referring to FIGS. 1 and 3, located on the upper works body 11 of the liftcrane are a first or rear hoist drum 30 and a second or front hoist drum 32.

Figure 5:
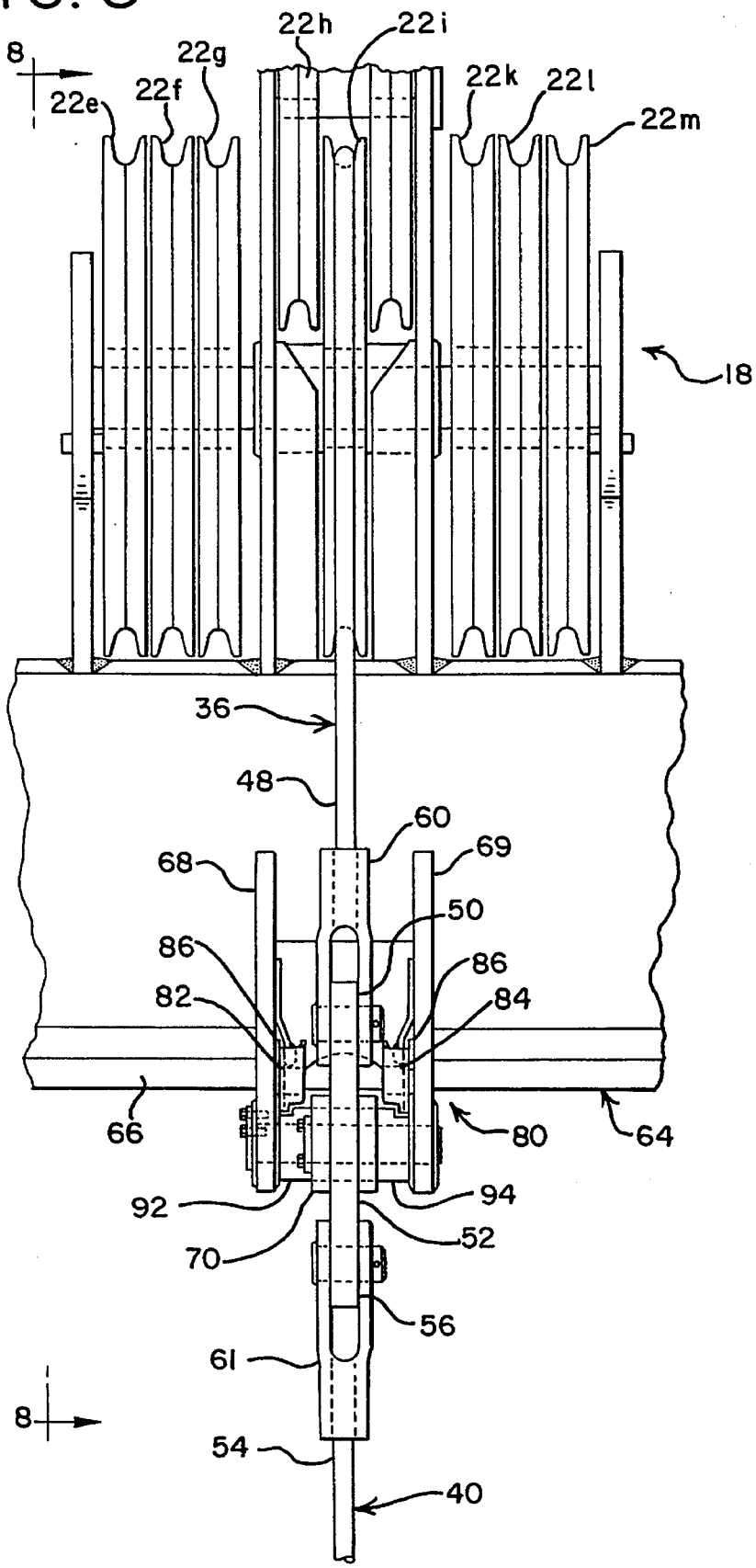
FIG. 5 is a front view of a portion of the upper half of the hoist block sheave arrangement shown in the embodiment of FIG. 1.
Figure 7:
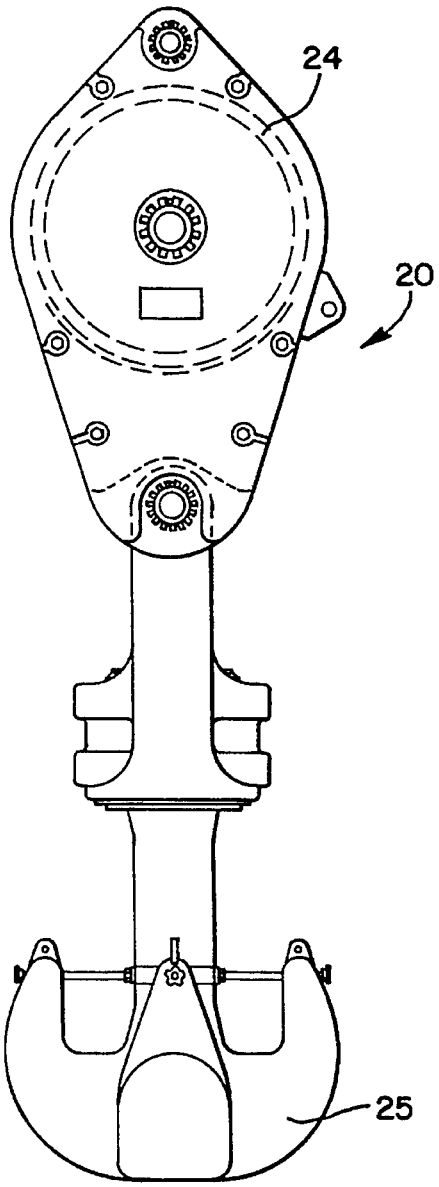
FIG. 7 is a side view of the lower half of the hoist block sheave arrangement shown in the embodiment of FIG. 1.
Figure 6:
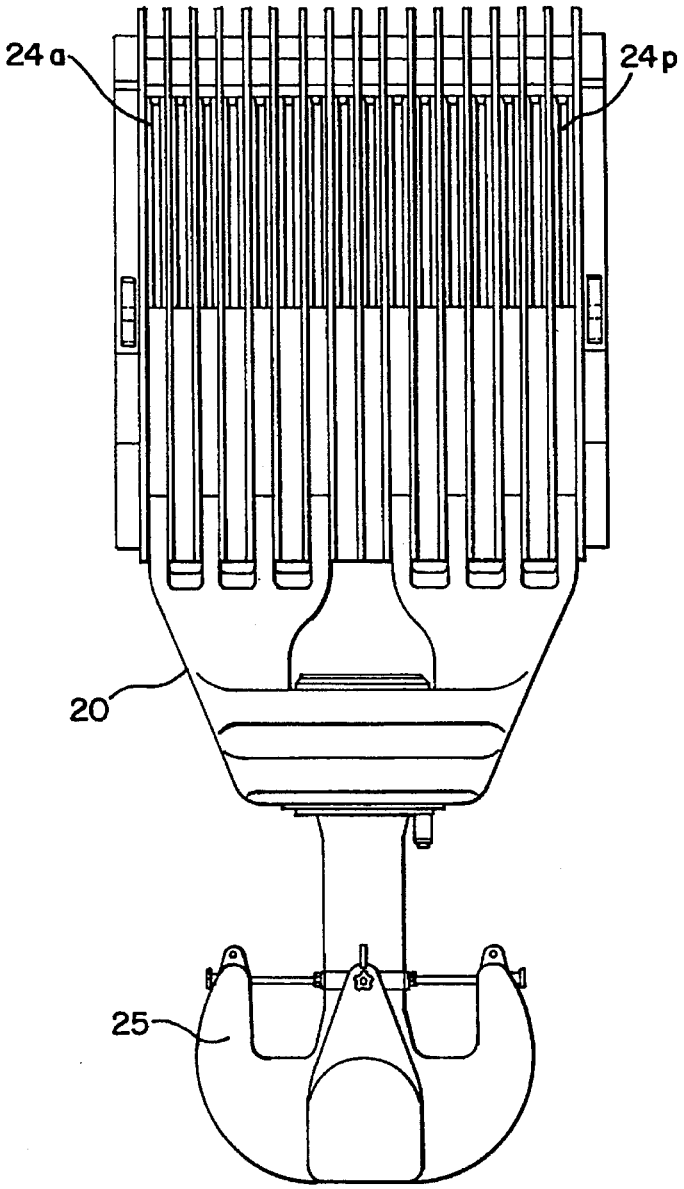
FIG. 6 is a front view of the lower half of the hoist block sheave arrangement shown in the embodiment of FIG. 1.
Figure 8:
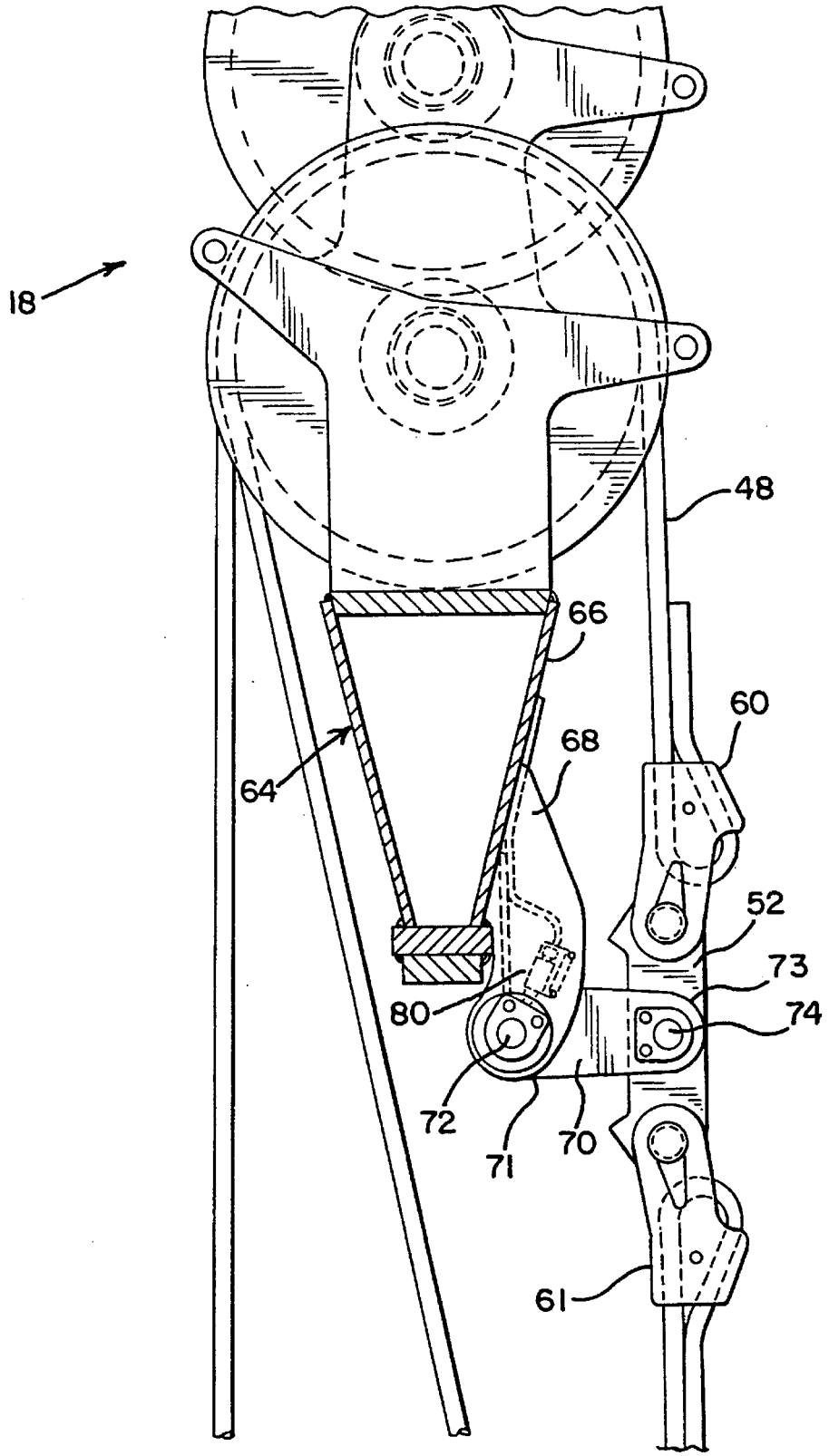
FIG. 8 is a sectional view taken along lines 8-8' of FIG. 5.

According to a preferred aspect of the invention, two separate ropes, or load lines, are used. A first rope or load line 36 is associated with the first hoist drum 30 and includes a first end 38 wound around the first hoist drum 30. A second rope or load line 40 is associated with the second hoist drum 32 and has a first end 42 wound around the second hoist drum 32. The first and second ropes 36 and 40 extend from the first and second hoist drums 30 and 32 up along the boom 12. In this embodiment, the first and second ropes 36 and 40 are reeved through the sheave arrangement 16 through the sheaves 22 and 24 of the upper and lower block halves 18 and 20. As shown in FIGS. 5 and 8, a second end 48 of the first rope 36 is connected to one side 50 of a link 52 and a second end 54 of the second rope 40 is connected to a second side 56 of the link 52. The link 52 is positioned in the hook block sheave arrangement between the upper and lower rows of sheaves. The second ends 48 and 54 of the two ropes are connected to the link 52 by an appropriate means, such as anchoring devices 60 and 61. It is preferable that the second ends of the ropes can be readily disconnected from the link as necessary.

Even though two separate pieces of rope are used, they function as a single piece of rope since they are connected to each other via the link 52. Thus, the link permits transfer of tension from one rope to the other so that the tension on both ropes is substantially equal. This permits the load to be lifted through the combined action of both hoist drums and permits a means for sensing the relative movement of the ropes if the tension is not equal, as explained below.

A sensor for sensing the relative movement of the ropes is connected to one of the block halves. Referring to FIGS. 5 and 8, in a preferred embodiment this sensor is connected to the upper block half 18 and specifically to an upper block frame 64 of the upper block half 18. The upper block frame 64 includes a base portion 66 and first and second arm portions 68 and 69 that are connected directly to the base portion 66 and which extend into proximity with the link 52. An actuator lever 70 has one end 71 located between the first and second arm portions 68 and 69 and pivotally connected thereto at 72. The other end 73 of the actuator lever 70 is pivotally connected to the link 52 at 74.

A sensor assembly 80 is mounted on the upper block frame 64. As shown in FIGS. 5 and 8, the sensor assembly 80 includes a first limit switch 82 and a second limit switch 84. Each of these limit switches is mounted on one of the arm portions, for example, the first limit switch 82 is mounted on the first arm portion 68 and the second limit switch 82 is mounted on the second arm portion 69. Mounting of the limit switches onto the arm portions may be facilitated by use of mounting pads 85 and 86. In a preferred embodiment, the mounting pads are clamped onto the arm portions 68 and 69 and the limit switches 82 and 84 are attached by bolts or other fasteners onto the pads. Other suitable means for mounting the limits switches may also be used.

Each of the limit switches includes a body portion and a roller pin portion. Referring to FIG. 8, the first limit switch 82 has a body portion 88 and a roller pin portion 90. The second limit switch 84 is similar or identical to the first limit switch. The roller pin portion 90 is biased to extend outward from the limit switch body portion 88. The roller pin portion 90 is slidable, upon application of sufficient force thereto, to move from an extended position to a retracted position. In the absence of a sufficient force applied thereto, the roller pin portion 90 assumes its fully extended position due to the biasing of the limit switch. The limit switches 82 and 84 output a signal indicative of the roller pin position, i.e. extended or retracted. The limit switches may do this by any suitable means such as for example outputting a high voltage signal indicative of one position and a low voltage signal indicative of the other position. Alternatively, the limit switches may output pulses or other signals indicative of a transition from one position, or state, to the other position or state. In a preferred embodiment, the limit switch used is a model 35ZS1 available from the Micro Switch Company.

Connected to the actuator arm 70 are a first cam 92 and a second cam 94. The first and second cams 92 and 94 may be formed of a single piece of metal with the actuator lever arm 70 or alternatively they may be formed of separate pieces and connected to it. First and second cams 92 and 94 are located between the arm portions 68 and 69 of the upper block frame 64. First and second cams 92 and 94 have their axes coincident with the axis of the pivotal connection 72 between the actuator arm 70 and the upper block frame 64. The first and second cams are connected to the actuator arm in a manner such that they move with the actuator arm 70 as it pivots about axis 72.

Figure 9:
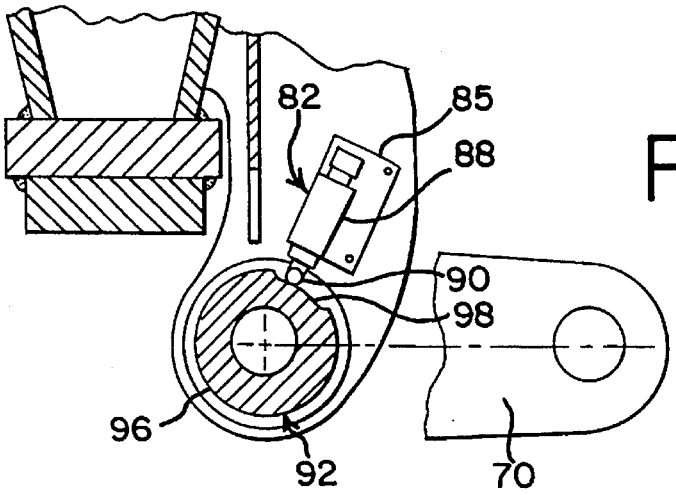
FIG. 9 is a sectional view showing a portion of FIG. 8.

First and second cams 92 and 94 have perimeter edges comprised of two sections. Referring again to FIG. 9, in a first cam perimeter section 96, which is approximately 314 degrees of the entire cam perimeter, the cam radius is of a first dimension and in a second cam perimeter section 98, which is the remaining approximately 46 degrees, the cam radius is of a second dimension which is less than the first dimension. In FIG. 9, the first limit switch 82 is shown with the actuator arm 70 in an approximately horizontal position. The first limit switch 82 is mounted on the arm portion 68 of the upper block frame 64 so that the roller pin 90 of the first limit switch 82 bears on the perimeter of the first cam 92. In the position shown in FIG. 9, the roller pin 90 bears on the second perimeter section 98 of the cam 92. In this position, the roller pin 90 of the limit switch 82 is in its extended, or biased outward, position.

Figure 10:
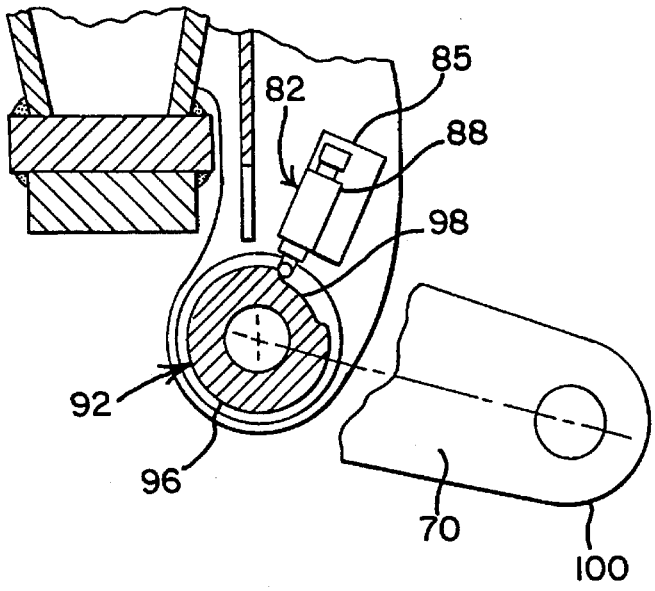
FIG. 10 is a sectional view similar to FIG. 9 showing the actuator arm in a first position.

Referring to FIG. 10, the actuator arm 70 is shown in phantom in a first position 100 in which the actuator arm 70 is rotated clockwise 15 degrees from the horizontal position of FIG. 9. When the actuator arm 70 is in the position shown in FIG. 10, the cam 92 has been rotated to a position at which the roller pin 90 of the limit switch 82 no longer bears on the lower perimeter section 98 of the cam 92, but instead the roller pin 90 bears on the upper perimeter section 96 of the cam. When the roller pin 90 bears on the higher perimeter section 96 of the cam, the roller pin 90 is forced from its extended position to its retracted position. When the roller pin 90 of the limit switch is moved from its extended to its retracted positions, the limit switch outputs a signal indicative of the roller pin position change.

The second limit switch 84 is mounted on the second arm portion 69 in a similar way as the first limit switch and bears on the second cam member 94 similarly. It is noted that whereas the first limit switch 82 is mounted to indicate actuator arm movement outside the range of 31 degrees counterclockwise from horizontal and 15 degrees clockwise from horizontal, the second limit switch 84 is mounted to indicate actuator arm movement 15 degrees counterclockwise from horizontal and 31 degrees clockwise from horizontal.

The limit switches send an output to a programmable controller that includes a CPU. The operation of the hoist drums 30 and 32 is under operation of the CPU so that the sensor input can be readily accommodated. The operation of hoist drums under the control of a programmable controller is described in detail in the related applications Ser. Nos. 07/566,751 and 07/418,879.

Figure 12:
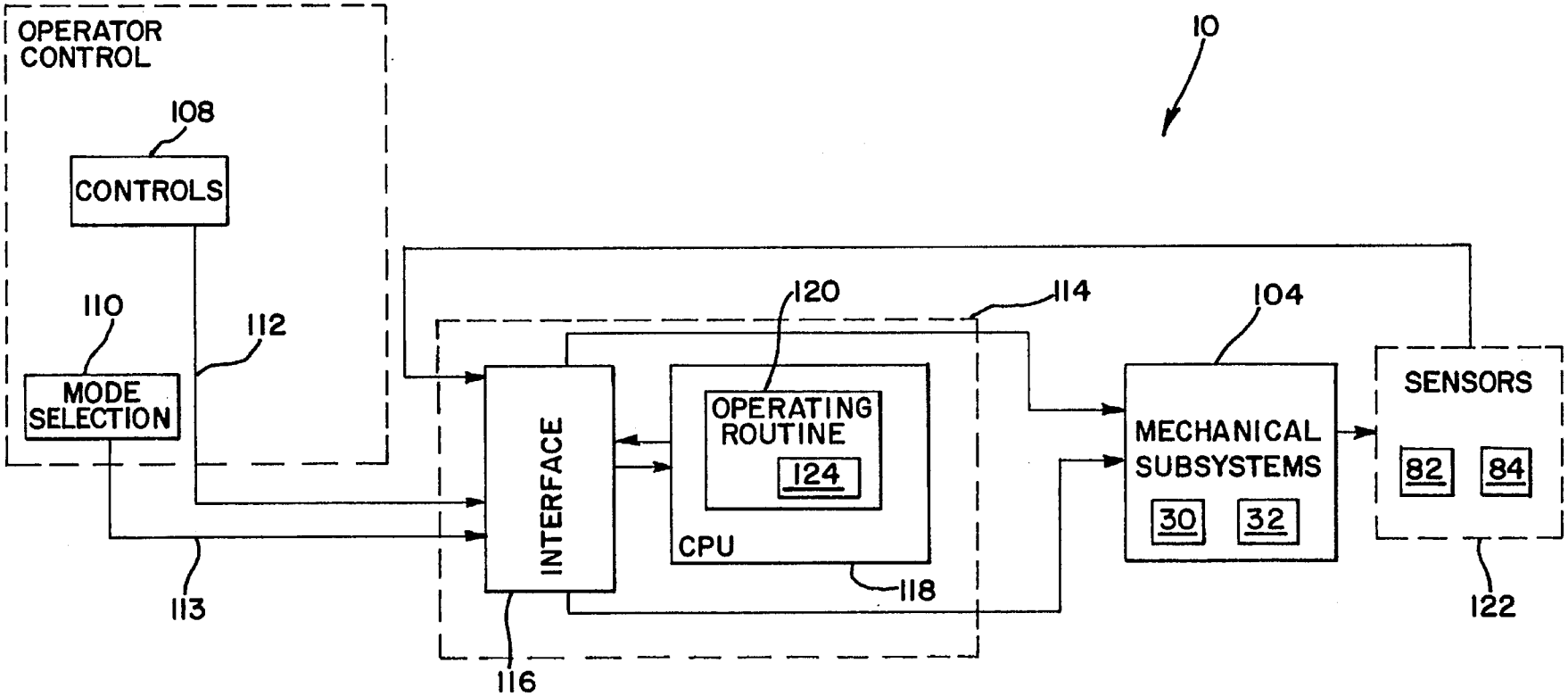
FIG. 12 is a block diagram of the control system for the liftcrane of FIG. 1.

Briefly, referring to FIG. 12, there is shown a block diagram of the control system for the embodiment of the liftcrane 10, described above. The various mechanical subsystems 104 of the liftcrane 10 include pumps and actuators for the front hoist 32, rear hoist 30, swing, boom, left and right crawlers, and so on. The mechanical subsystems 104 are under the control of an operator who occupies a position in the cab 106 (of FIG. 1) in the upper works 11 of the liftcrane. In the cab 106 are various operator controls 108 used for operation and control of the mechanical systems 104 of the liftcrane and which preferably include a mode selector 110 whose function is to tailor the operation of the liftcrane for specific type of activities. The outputs 112 and 113 of the operator controls 108 and the mode selector 110 are directed to a controller 114 and specifically to an interface 116 of the controller 114. The interface 116 in turn is connected to a CPU (central processing unit) 118. The controller 114 may be a unit such as the model IHC (Intelligent Hydraulic Controller) manufactured by Hydro Electronic Devices Corporation. The CPU 118 may be an Intel 8052. The CPU 118 runs a routine 120 which recognizes and interprets the commands from the operator (via the operator control 108) and outputs information back through the interface 116 directing the mechanical subsystems 104 to function in accordance with the operator's instructions. Movements, positions and other information about the mechanical subsystems 104 are monitored by sensors 122. These sensors 122 include the limit switches 82 and 84. Information from the sensors 122 is fed back to the interface 116 and in turn to the CPU 118. This information about the mechanical subsystems 104 provided by the sensors 122 is used by the routine 120 running on the CPU 118 to determine if the liftcrane is operating properly and responding to the operating commands.

Figure 13A:
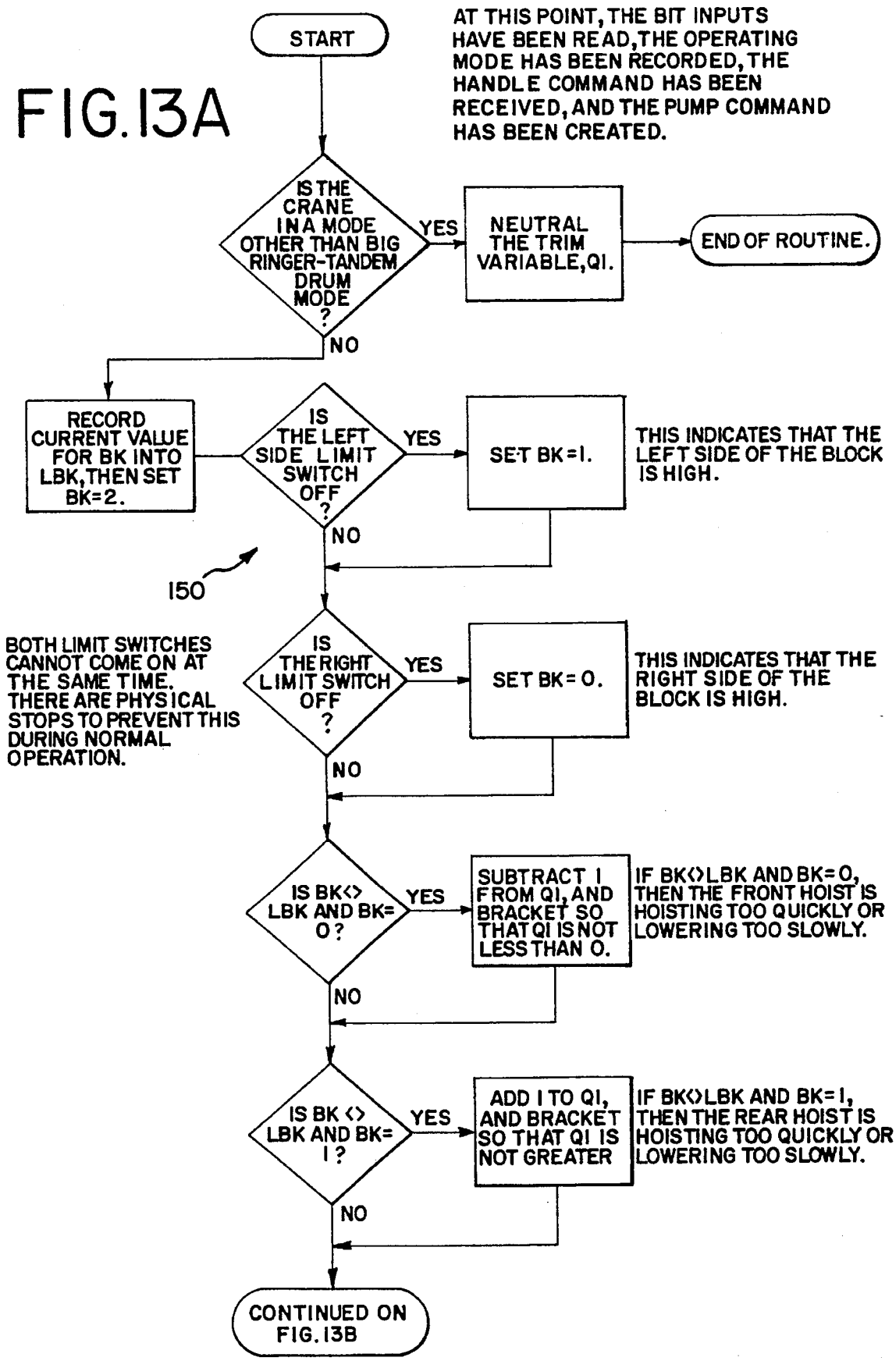
FIGS. 13A and 13B are a flow chart of the drum synchronization control routine shown in FIG. 12.
Figure 13B:
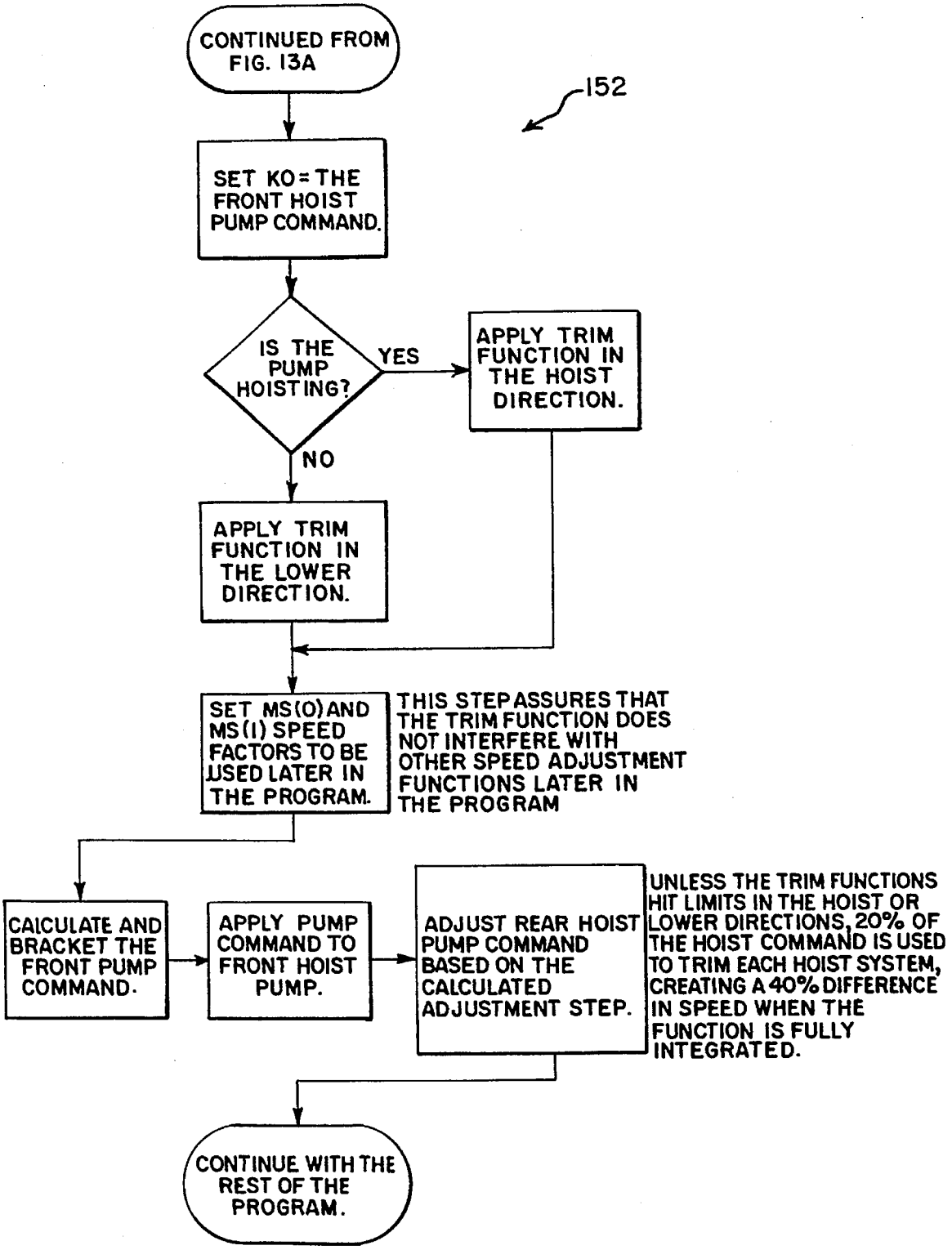

In accordance with a present embodiment, the controller 114 runs a drum synchronization routine 124. This drum synchronization routine 124 is preferably incorporated as a subroutine that is part of a general operating routine 120 that controls operation of the entire liftcrane 10 including all its mechanical systems and subsystems. The source code for the drum synchronization routine is included in Appendix A. FIGS. 13A and 13B are a flow chart of the hoist drum synchronization routine 124 that may be used to operate the first and second hoist drums in accordance with this embodiment of the present invention.

According to the present embodiment, the operator in the liftcrane cab operates the liftcrane controls to lift a load with the liftcrane with the hoist block sheave arrangement, as illustrated in FIG. 1. The load 14 has been attached to the hook 25 of the hoist block sheave arrangement 16. The operator manipulates the controls 108 to cause the first hoist drum 30 and the second hoist drum 32 to rotate to lift the load 14 through the combined action of both hoist drums. During the lifting, if the rope 40 from the second (front) hoist drum 32 runs slower than the rope 36 from the first (rear) hoist drum 30, the speed difference will cause the actuator lever 70 to rotate counterclockwise until the 15 degrees position is reached, as illustrated in FIG. 10. At this point, the roller pin 90 on one of the limit switches, i.e. the first limit switch 82, moves from the lower cam perimeter section 98 to the higher cam perimeter section 96 thereby causing the limit switch 82 to output a signal to the controller 114. This condition is represented in FIG. 13A at 150. When this occurs, the drum synchronization routine 124 outputs a command to the first hoist drum 30 to slow down and to the second hoist drum 30 to speed up to maintain a constant hook speed. This condition is represented in FIG. 13B at 152. This output command serves as a correction that keeps operation of the drums synchronous. With this correction, the actuator arm 70 returns to its horizontal position, as shown in FIG. 9.

It should be understood that the operation of lifting includes the operation of lowering as well since similar considerations and conditions apply. For example, if the front drum is operating faster than the rear drum, the link shifts the actuator arm 70 and if the shift exceeds approximately 15 degrees, the limit switch outputs a signal to the controller to slow down the front drum and/or speed up the rear drum.

With the improvement described above, disassembly of the crane 10 is facilitated. Because two shorter ropes can be used instead of a single longer rope, it is possible to wind the entire lengths of the two shorter ropes on the two hoist drums. According to this procedure, the ropes 36 and 40 are disconnected at the second ends thereof 48 and 54 from the link 52. Then, the ropes can be fully retracted from the sheaves and boom and wound onto the hoist drums.

ALTERNATIVE EMBODIMENTS

According to another embodiment of the present invention, the drum synchronization routine can provide a second limit safety feature. This second limit feature prevents the actuator arm from travelling too far from its horizontal position.

Figure 11:
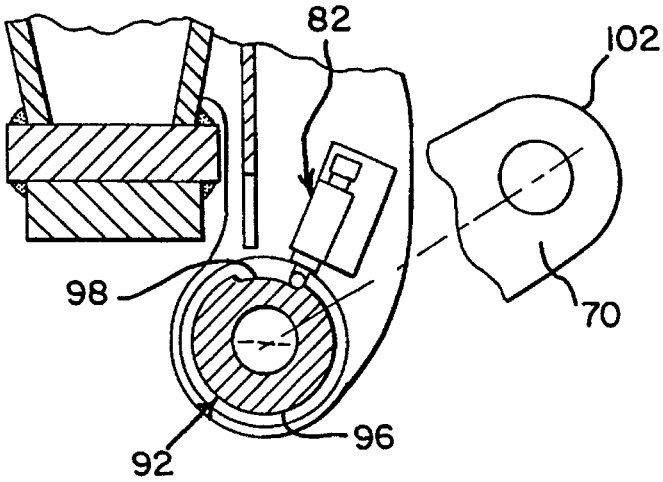
FIG. 11 is a sectional view similar to FIG. 9 showing the actuator arm in a second position.

Referring to FIG. 11, the actuator arm 70 is shown in a second position 102 in which the actuator arm 70 is shown rotated 31 degrees counterclockwise from the horizontal position of FIG. 9. When the actuator arm 70 has moved to the position shown in FIG. 11, the cam 92 has been rotated to a position at which the roller pin 90 of the limit switch 82 is at the other end of the lower perimeter 98 of the cam perimeter (relative to FIG. 10). In this position also the roller pin 90 no longer bears on the lower perimeter section 98 of the cam 92, but instead the roller pin 90 bears on the upper perimeter section 96 of the cam and, as before, the limit switch outputs a signal indicative of the roller pin position change.

In this additional embodiment, the first limit switch 82 will also output a signal that it is on the higher perimeter section 96 if the actuator lever 70 has travelled more than 31 degrees counterclockwise from the horizontal and the second limit 84 switch will output a signal that it is on the higher perimeter section 96 if the actuator lever has travelled more than 31 degrees clockwise from the horizontal. Under these conditions, the drums are signaled to operate to effect maximum correction of the speed differential. Alternatively, the drums may be signaled to stop or shut down. Code and pseudo-code for this alternative embodiment of the drum synchronization routine using a second limit is included in Appendix B.

In the embodiments described above, it is assumed that the first and second hoist drums are fully under control of the programmable controller, however, it is also intended that an embodiment of the present invention could be incorporated in a liftcrane in which the hoist drums are under direct control of the control levers in the operator's cab. In such an arrangement, an embodiment of the present invention could be used to augment direct operator control. For example, in such an embodiment, the sensor assembly could function to trim the take up of one or the other of the hoist drums upon sensing that the take up rate of one of the ropes was exceeding that of the other of the ropes by too great a margin. However, at other times, the sensor assembly would return direct control of the hoist drums to the operator. Such an embodiment could be implemented without a CPU but use simple switches instead.

In a preferred embodiment of the present invention, the drum synchronization system is used with hoist drums and a hoist block sheave arrangement. However, it is contemplated that the synchronization system could also be used with other types of mechanical systems other than just hoist drums. Also, the synchronization system could be used with two ropes or load lines but without the hoist block sheave arrangement.

Although it is advantageous to use two ropes, for the reasons stated above, it is also contemplated that present invention could be used in a single rope arrangement. In a single rope system such as when a hoist block sheave arrangement is used, it may be advantageous to incorporate the safety feature, described above. In a single rope system, one of the hoist drums may become inoperative or the rope may become tangled in the sheaves. This results in isolating one of the hoist drums from the load, and in such circumstances lifting of the load would be performed by only one of the hoist drums. When this happens, it results in a shifting of the rope relative to the load. This condition could be detected by an embodiment of the present invention in which a sensor associated with the rope outputs a signal to indicate that the two lengths of rope leading back from the load are shifting relative to each other. The operation of the hoist drums would be modified to balance the take up rates in a manner similar to that described above.

It is also noted that although in a preferred embodiment the sensor is mechanically attached to a link connecting the two ropes, it would also be possible to detect movement of the two ropes relative to each other by non-mechanical means. For example, shifting of the link and/or the ropes could be detected by an optical sensor, a magnetic sensor, or other types of sensors that employ other than mechanical connections, e.g. Hall effect, capacitive, etc. This detection could be performed at locations other than at the rope ends.

It is intended that the detailed description herein be regarded as illustrative rather than limiting, and that it be understood that it is the claims, including all equivalents, which are intended to define the scope of the invention.

We claim:

1. A liftcrane for lifting loads comprising:

a first hoisting mechanism;

a second hoisting mechanism;

a first rope having a first end wound on the first hoisting mechanism and a second rope having a first end wound on the second hoisting mechanism, and further in which a second end of said first rope is connected to a second end of said second rope in a manner that transfers tension between said ropes so that a load coupled to one of said ropes can be hoisted by combined action of the first hoisting mechanism and the second hoisting mechanism;

a sensor responsive to movement of the connection between said first rope and said second rope; and a controlling mechanism associated with said first hoisting mechanism and said second hoisting mechanism, said controlling mechanism comprising a processor and a synchronization routine on said processor, said synchronization routine adapted to provide an output to modify operation of said first and second hoisting mechanisms to maintain a rate at which the first rope is taken up relatively uniform with a rate at which the second rope is being taken up.

2. The liftcrane of claim 1 further comprising:

a hoist block arrangement having an upper block half and a lower block half and a plurality of sheaves on said upper and lower block halves through which said ropes are reeved.

3. The liftcrane of claim 2 further comprising:

a hook attached to said lower block half for attaching to a load.

4. The liftcrane of claim 1 in which said controlling mechanism further comprises:

a sensor adapted to detect a relative difference in said rates and output a signal indicative thereof; and a processor for receiving the signal from said sensor and providing an output to at least one of said first hoisting mechanism and said second hoisting mechanism to adjust at least one of said rates.

5. A liftcrane comprising:

a boom;

a first hoist drum;

a first load line extending along said boom, said first load line having a first end wound on said first hoist drum and a second end;

a second hoist drum;

a second load line extending along said boom, said second load line having a first end wound on said second hoist drum and a second end coupled to said second end of said first load line;

a coupling for attaching at least one of said first and second load lines to a load in such manner that tension can be transmitted between said first and second load lines;

a sensor associated with at least one of said load lines to detect whether a rate at which the first load line is taken up varies with respect to a rate at which the second load line is taken up;

a processor; and a synchronization routine run on said processor, said synchronization routine adapted to provide an output to modify operation of said first and second hoist drums based upon output from said sensor.

6. The liftcrane of claim 5 further comprising:

a hoist block arrangement having an upper block half and a lower block half and a plurality of sheaves on said upper and lower block halves through which said first load line and said second load lines are reeved.

7. The liftcrane of claim 5 further comprising:

a controller for receiving a signal output from said sensor, said controller providing an output to said first hoist drum and said second hoist drum to adjust said rates as a function of said signal received from said sensor.

8. A liftcrane comprising:

a boom;

a first hoist drum;

a first rope extending along said boom, said first rope having a first end connected to said first hoist drum and a second end connected to a link;

a sensor adapted to detect movement of said link;

a second hoist drum;

a second rope extending along said boom, said second rope having a first end connected to said second hoist drum and a second end connected to said link;

a coupling for connecting at least one of said first and second ropes to a load while allowing tension to be distributed between said first rope and said second rope so that the load can be lifted by both said first and said second hoist drums; and a controller operatively connected to said hoist drums and said sensor, said controller comprising a processor and a synchronization routine on said processor adapted to modify operation of said first hoist drum and said second hoist drum based upon an input from said sensor.

9. The liftcrane of claim 8 further comprising:

an actuator lever arm connected to said link and having a cam portion;

and wherein said sensor comprises:

at least one limit switch bearing on said cam portion.

10. The liftcrane of claim 8 in which said synchronization routine comprises:

a first subroutine portion responsive to sensor detection of link movement of a first threshold amount; and a second subroutine portion responsive to sensor detection of link movement of a second threshold amount, said second threshold amount being greater than said first threshold amount.

11. The liftcrane of claim 10 in which said first subroutine portion outputs a first command for operation of said first hoist drum and said second hoist drum and said second subroutine portion outputs a second command for operation of said first hoist drum and said second hoist drum, said second command being different than said first command.

12. The liftcrane of claim 8 further comprising:

a safety mechanism associated with said first and second hoist drums and adapted to modify operation of said first and said second hoist drums upon detection of a threshold amount of relative movement between said second end of said first rope and said second end of said second rope.

* * * * *